US008843054B2

(12) United States Patent
Uchida

(10) Patent No.: US 8,843,054 B2
(45) Date of Patent: Sep. 23, 2014

(54) INKJET RECORDING APPARATUS

(75) Inventor: Haruo Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 314 days.

(21) Appl. No.: 12/966,388

(22) Filed: Dec. 13, 2010

(65) Prior Publication Data

US 2011/0142516 A1 Jun. 16, 2011

(30) Foreign Application Priority Data

Dec. 15, 2009 (WO) ..... PCT/JP2009/070921

(51) Int. Cl.

| | |
|---|---|
| ***G03G 15/00*** | (2006.01) |
| ***B41J 3/44*** | (2006.01) |
| ***B41J 3/407*** | (2006.01) |
| ***B41J 3/60*** | (2006.01) |

(52) U.S. Cl.

CPC *B41J 3/4071* (2013.01); *B41J 3/44* (2013.01); *B41J 3/60* (2013.01)

USPC ..... 399/401; 347/104; 101/41; 101/42; 101/43; 101/44; 400/23; 400/48

(58) Field of Classification Search

CPC ..... G03G 15/234; B65H 2301/33312; B41J 3/44; B41J 3/4071

USPC ..... 399/401; 101/41, 42, 43, 44; 347/104; 400/23, 48

See application file for complete search history.

(56) References Cited

U.S. PATENT DOCUMENTS

| | | | | |
|---|---|---|---|---|
| 7,431,282 | B2 * | 10/2008 | Ohama | 271/65 |
| 8,246,160 | B2 * | 8/2012 | Uchida | 347/104 |
| 2007/0147919 | A1 * | 6/2007 | Lim | 399/388 |
| 2008/0278523 | A1 | 11/2008 | Uchida | |
| 2009/0295067 | A1 * | 12/2009 | Yanagishita | 271/10.12 |

FOREIGN PATENT DOCUMENTS

| | | | |
|---|---|---|---|
| JP | 2005-074905 | A | 3/2005 |
| JP | 2008-280126 | A | 11/2008 |
| JP | 2009-262358 | A2 | 11/2009 |

OTHER PUBLICATIONS

Machine Translation of JP 2009262358, Published Nov. 12, 2009.*

* cited by examiner

*Primary Examiner* — Matthew G Marini
*Assistant Examiner* — Allister Primo
(74) *Attorney, Agent, or Firm* — Canon USA, Inc. IP Division

(57) ABSTRACT

A downsized recording apparatus capable of housing inside a holding member that holds a disc recording medium so as to convey the disc recording medium. The recording apparatus includes a conveyance unit that conveys a sheet; a recording unit that performs recording on the sheet conveyed by the conveyance unit; a duplex conveyance path that guides the sheet having recording performed on a first side thereof by the recording unit and reverses the sheet before guiding the sheet to the conveyance unit so that recording is performed on a second side of the sheet having recording performed on the first side thereof, the second side being opposite the first side; a holding-member-housing portion provided at a position enclosed by the duplex conveyance path, the portion housing a holding member that holds a disc recording medium; and a moving unit that moves the holding member to the conveyance unit so that the holding member is conveyed by the conveyance unit.

8 Claims, 7 Drawing Sheets

INKJET RECORDING APPARATUS

BACKGROUND OF THE INVENTION

1. Field of the Invention

The present invention relates to an inkjet recording apparatus capable of printing an image on a disc recording medium such as a CD or DVD.

2. Description of the Related Art

Exemplary conventional inkjet recording apparatuses capable of printing images on disc recording media such as CDs and DVDs include a recording apparatus disclosed in Japanese Patent Laid-Open No. 2005-74905. In the recording apparatus disclosed in Japanese Patent Laid-Open No. 2005-74905, a conveyance tray for a CD or DVD, when not used, is housed in a portion on the upstream side with respect to a conveyance roller. When printing is performed on a disc recording medium, the conveyance tray is conveyed out to the front of the body of the apparatus. Subsequently, when a disc recording medium is set on the conveyance tray, the recording apparatus draws the conveyance tray thereinto and performs printing on the disc recording medium while conveying the medium. After the printing is finished, the conveyance tray is conveyed out to the front of the body of the apparatus.

To perform printing on another disc recording medium, the recording media are changed by user operation, and the above operation is repeated. To end printing, the disc recording medium is removed by user operation, and the conveyance tray is drawn into the body of the apparatus by an operation on the side of the body and is conveyed to a conveyance-tray-housing position on the upstream side with respect to the conveyance roller. Thus, the operation ends.

The recording apparatus disclosed in Japanese Patent Laid-Open No. 2005-74905 had a space exclusively provided for housing the conveyance tray for a disc recording medium behind a recording unit in the body of the apparatus. Furthermore, since the conveyance tray was conveyed from behind the recording unit to the front surface of the apparatus by a rack provided on the conveyance tray and a pinion gear provided on the body and meshing with the rack, the rack needed to be relatively long. Therefore, the conveyance tray itself was long, increasing the depth of the body so as to provide the space for housing the conveyance tray. This prevented the downsizing of the body of the apparatus.

It is an object of the present invention to provide a downsized recording apparatus capable of housing thereinside a holding member that holds a disc recording medium so as to convey the disc recording medium.

SUMMARY OF INVENTION

A configuration of the present invention for achieving the above object provides a recording apparatus including a conveyance unit configured to convey a sheet; a recording unit configured to record on the sheet conveyed by the conveyance unit; a duplex conveyance path that guides the sheet having recording performed on a first side thereof by the recording unit and reverses the sheet before guiding the sheet to the conveyance unit so that recording is performed on a second side of the sheet having recording performed on the first side thereof, the second side being opposite the first side; a holding-member-housing portion provided at a position enclosed by the duplex conveyance path, the portion housing a holding member that holds a disc recording medium; and a moving unit that moves the holding member to a position where the holding member is conveyable by the conveyance unit so that the holding member is conveyed by the conveyance unit.

Further features of the present invention will become apparent from the following description of exemplary embodiments with reference to the attached drawings.

DESCRIPTION OF THE EMBODIMENTS

Figure 1:
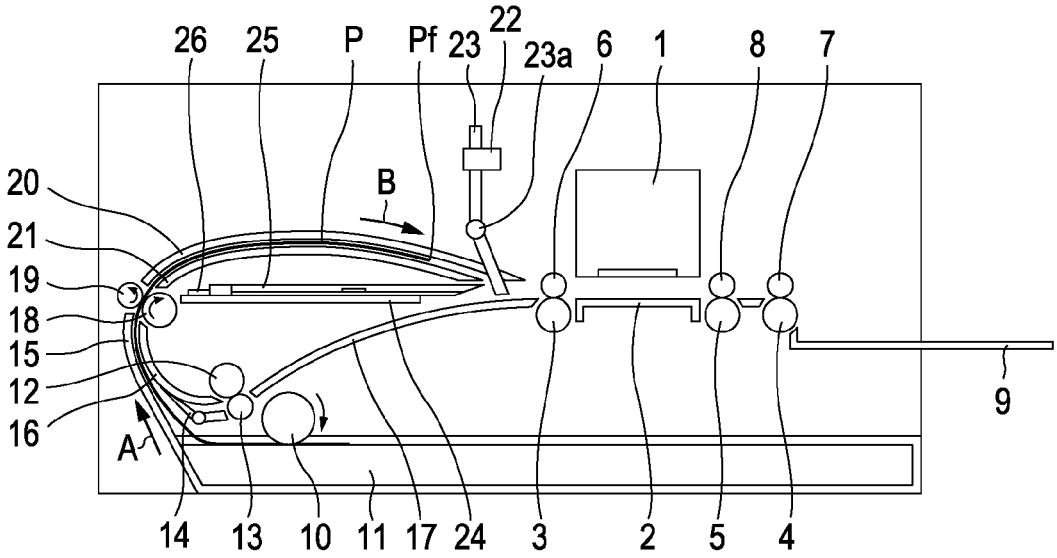
FIG. 1 is a schematic cross-sectional view of a recording apparatus according to a first embodiment of the present invention.

Referring to FIG. 1, the functions of elements included in a recording apparatus according to a first embodiment of the present invention will now be described.

Recording sheets P are stacked in a stacking unit 11 provided at the bottom of a body of the recording apparatus. The recording sheets P that are stacked are each conveyed in the direction of an arrow A by a feeding roller 10, which is a feeding unit. The recording sheet P is guided to an intermediate conveyance roller 18 by conveyance guides 14 and 15, which form a feeding path. Reference numeral 19 denotes a pinch roller that pinches the recording sheet P in combination with the intermediate conveyance roller 18.

The recording sheet P conveyed by the intermediate conveyance roller 18 is guided to a conveyance roller 3 by conveyance guides 20 and 21. Reference numeral 6 denotes a pinch roller that presses the recording sheet P against the conveyance roller 3. A sensor 22 and a sensor lever 23 are provided on the upstream side with respect to the conveyance roller 3, whereby a sheet detecting unit that detects the recording sheet P is provided. The sensor lever 23 swings by coming into contact with the recording sheet P that is being moved. The sensor lever 23 is swingably supported by a shaft 23*a*. The sensor 22 includes a light emitter and a photodetector that detects light from the light emitter. When the recording sheet P is not detected, the upper end of the sensor lever 23 blocks the optical path of the light emitter, and the photodetector does not detect the light from the light emitter. When the recording sheet P that is being conveyed comes into contact with the sensor lever 23 and causes the sensor lever 23 to swing, the upper end of the sensor lever 23 retracts from the optical path of the light emitter, and the photodetector detects the light from the light emitter. Thus, the passage of the leading end of the recording sheet P is detected.

A duplex conveyance path is provided on the upstream side with respect to the conveyance roller 3. The duplex conveyance path is provided for conveying a recording sheet P having recording performed thereon from the recording unit and returning the recording sheet P to the recording unit again so that duplex recording is performed. The duplex conveyance path is formed of a duplex conveyance guide 17 and the conveyance guides 14, 15, 16, 20, and 21. That is, the feeding path that guides the recording sheet fed from the stacking unit 11 by the feeding roller joins the duplex conveyance path.

When duplex recording is performed, the recording sheet P having recording performed on the front side, which is a first side, thereof is conveyed in a backward direction by the conveyance roller 3, whereby the recording sheet P is guided into the duplex conveyance path, where the recording sheet is reversed. The recording sheet P conveyed in the backward direction is guided into the duplex conveyance path by a conveyance tray 25 for a disc recording medium, as described separately below. In the duplex conveyance path, the recording sheet is guided to a duplex conveyance roller 12 by the duplex conveyance guide 17. Reference numeral 13 denotes a pinch roller that pinches the recording sheet P in combination with the duplex conveyance roller 12. While being conveyed by the duplex conveyance roller 12, the recording sheet P is guided by the paper guides 14 and 16, is conveyed by the intermediate conveyance roller 18, is guided by the conveyance guides 20 and 21, passes through the duplex conveyance path, and reaches the conveyance roller 3 again. The recording sheet P that has passed through the duplex conveyance path has a second side thereof, opposite the first side thereof, face a recording head 1.

The recording unit will now be described. The recording unit includes the recording head 1 and a platen 2 that supports the recording sheet P at a position facing the recording head 1. The recording sheet P is conveyed by the conveyance roller 3 intermittently by units of specific lengths. While the recording sheet P remains still between conveyance motions, the recording head 1 ejects ink while moving in a direction orthogonal to a recording-sheet-conveyance direction, thereby performing recording in the conveyance direction and over a specific width.

A second discharge roller 5 and a first discharge roller 4 are provided on the downstream side with respect to the recording unit. Reference numerals 8 and 7 denote spur-type pinch rollers that press the recording sheet P against the second discharge roller 5 and the first discharge roller 4, respectively. The second discharge roller 5 and the first discharge roller 4 perform conveyance of the recording sheet P during recording and conveyance for discharging the recording sheet P. The recording sheet P thus discharged is discharged to a discharge tray 9.

Figure 3:
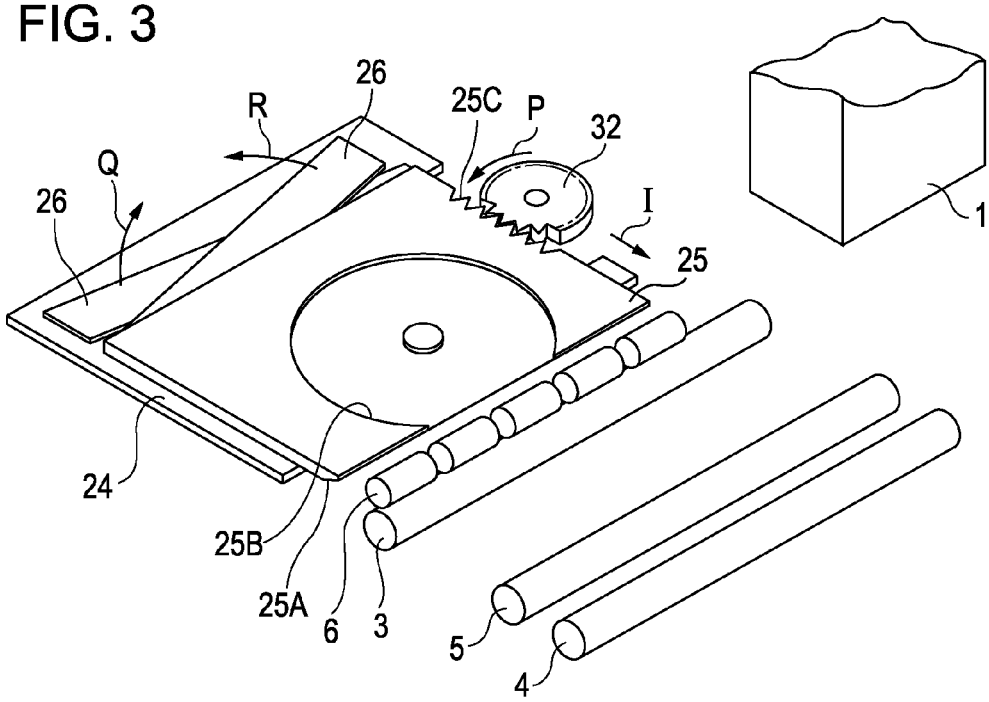
FIG. 3 is a diagram showing a moving unit for a conveyance tray.

The conveyance tray 25 for a CD or DVD will now be described. When printing is performed on a resin disc recording medium such as a CD or DVD, the disc recording medium is made to be held by a holding member. The holding member holding the disc recording medium is pinched by the conveyance roller and the pinch roller intended for a recording sheet, whereby the disc recording medium is conveyed. The conveyance tray 25, functioning as the holding member for a disc recording medium, is housed in a holding-member-housing portion provided in an area enclosed by the duplex conveyance path. The conveyance tray 25 is movably positioned on a conveyance tray guide 24 provided at a position enclosed by the duplex conveyance path. As shown in FIG. 3, the conveyance tray 25 has on a side end thereof a rack 25C, with which a pinion gear 32 selectively meshes. When the pinion gear 32 is driven to rotate in a direction P by a motor, which is a drive source, the pinion gear 32 meshes with the rack 25C and moves the conveyance tray 25 in the direction of an arrow I. When the conveyance tray 25 is moved by the rack 25C, the pinion gear 32, and the motor, which form a moving unit, to a position where the conveyance tray 25 is conveyable by the conveyance rollers, the conveyance tray 25 is pinched by the conveyance roller 3 and the pinch roller 6 and is conveyed by the conveyance roller 3.

Figure 7A:
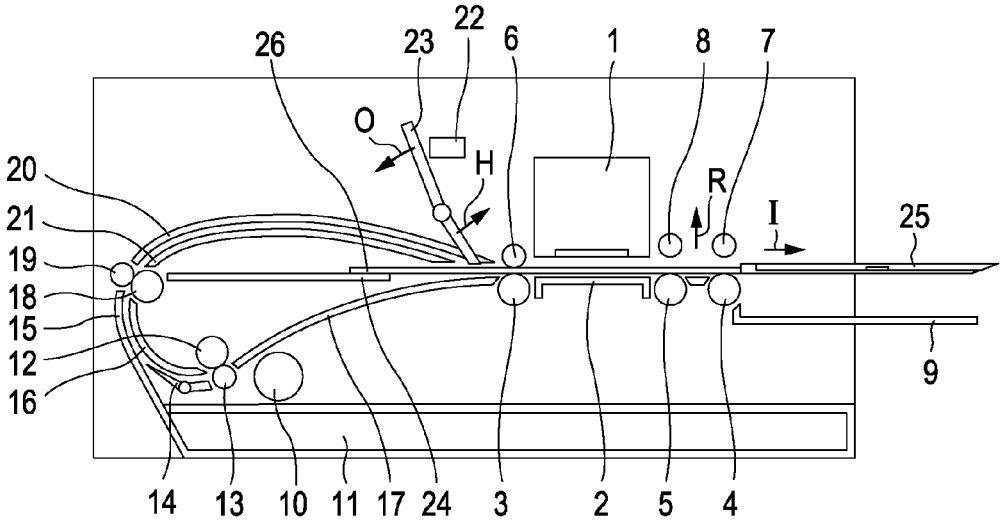
FIGS. 7A and 7B are diagrams for describing an operation performed when recording is performed on a disc recording medium.
Figure 7B:
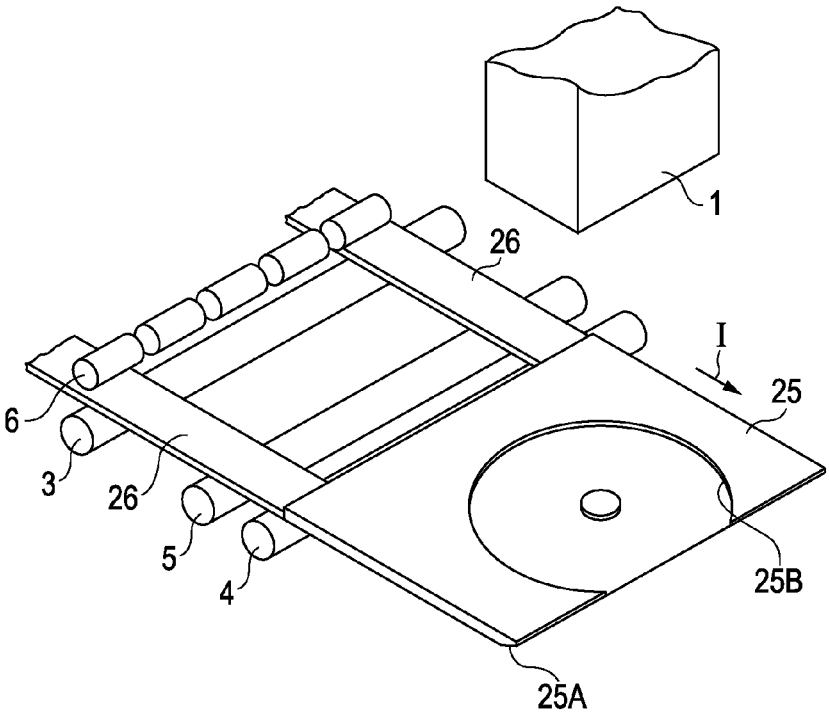

The conveyance tray 25 has at the two corners on the rear thereof conveyance assisting members 26 for assisting the conveyance of the conveyance tray 25. Along with the conveyance of the conveyance tray 25 in the direction of the arrow I, the conveyance assisting members 26 that are in a folded state are rotated in the directions of arrows Q and R, respectively, by an unshown guide mechanism while crossing each other. The assistive conveyance trays 26 are each eventually rotated by 90 degrees and extend parallel to the conveyance direction as shown in FIG. 7B. In this state, conveyance is performed.

Figure 4:
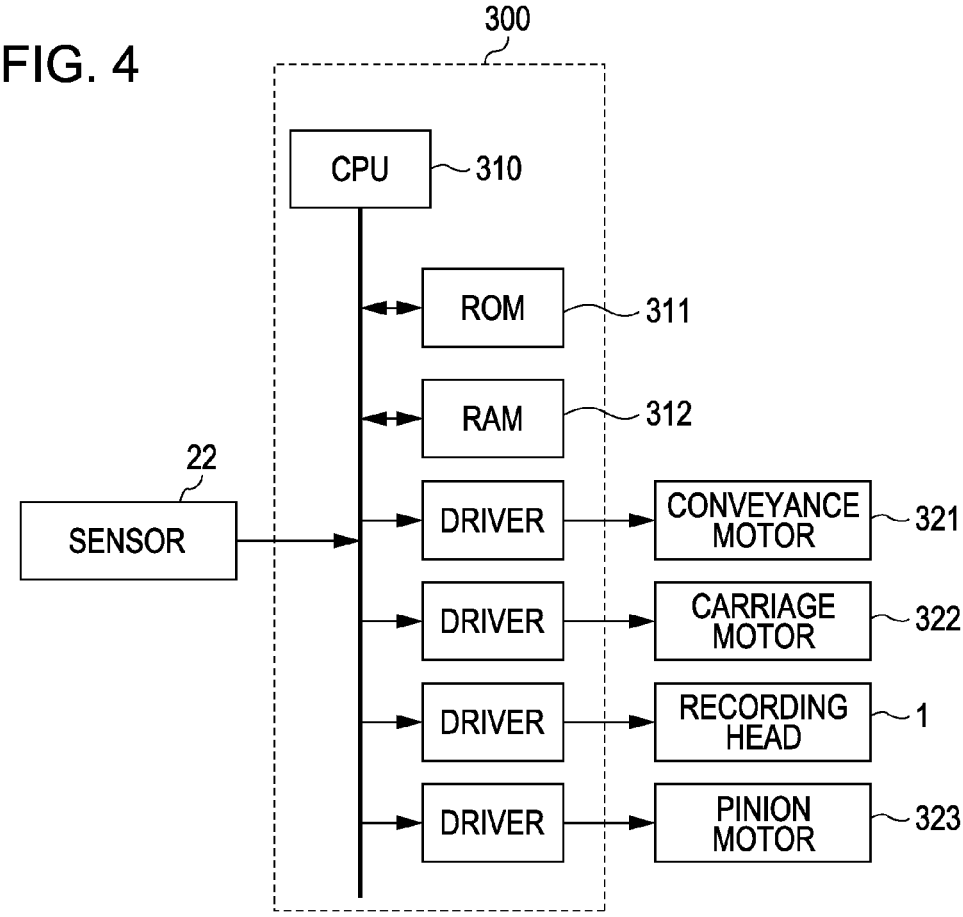
FIG. 4 is a diagram showing a control circuit of the recording apparatus.

FIG. 4 shows a control circuit of the recording apparatus. A control unit 300, which is a control unit, includes a CPU 310, a ROM 311 storing programs and fixed data, a RAM 312 having spaces in which image data is decompressed and other works are performed.

Reference numeral 321 denotes a conveyance motor that drives the conveyance roller 3, reference numeral 322 denotes a carriage motor that moves the recording head 1 so as to perform scanning, and reference numeral 323 denotes a pinion motor that drives the pinion gear 32 that moves the conveyance tray 25. The control unit further includes drivers that drive the foregoing motors and the recording head 1.

Figure 2:
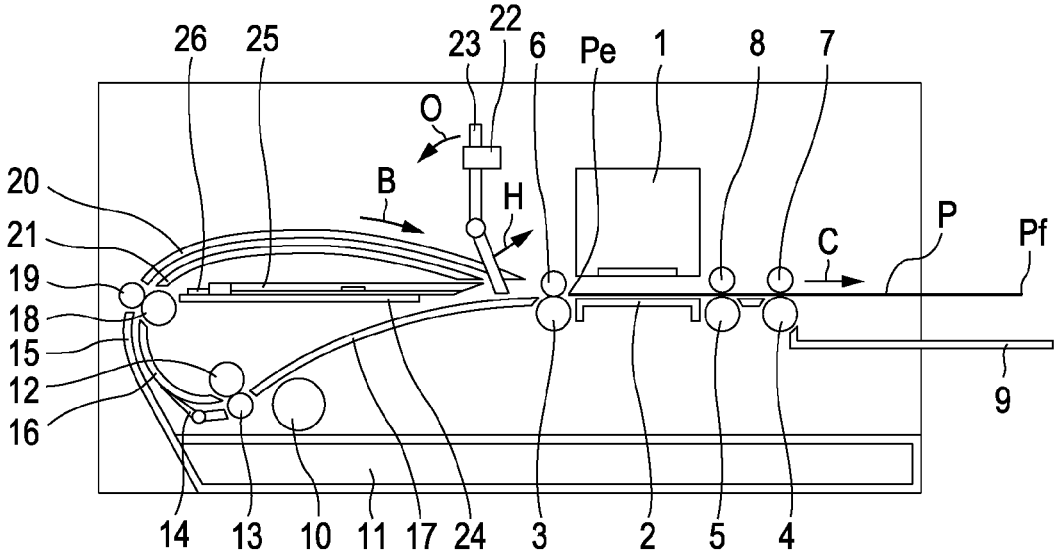
FIG. 2 is a schematic cross-sectional view for describing an operation of the recording apparatus.

A recording operation will now be described. In FIG. 1, recording sheets P stacked in the feeding-and-stacking unit 11 are each conveyed in the direction of the arrow A by the feeding roller 10. The recording sheet P is guided to the intermediate conveyance roller 18 by the conveyance guides 14, 15, and 16, and is further guided to the pair of rollers 3 and 6 in the direction of an arrow B by the paper conveyance guides 20 and 21. Subsequently, as shown in FIG. 2, the recording sheet P is conveyed to the recording unit by the pair of rollers 3 and 6. Here, the recording sheet P causes the sensor lever 23 to turn in the direction of an arrow H, and a sensor detection portion at the upper end of the sensor lever 23 moves in the direction of an arrow O, whereby the recording sheet P is detected by the sensor 22.

The recording sheet P is conveyed by the conveyance roller 3 in the direction of an arrow C by units of specific lengths. While the recording sheet P remains still between conveyance motions, the recording head 1 ejects ink while moving, thereby performing recording over a specific width. The conveyance by the conveyance roller 3 and the recording by the recording head 1 are alternately performed. Thus, an image is formed on the recording sheet P.

As the recording sheet P advances, the second discharge roller 5 and the first discharge roller 4 are involved in the conveyance. Subsequently, a trailing end Pe of the recording sheet P passes through the nip between the conveyance roller 3 and the pinch roller 6, and the recording on the front side is finished. If recording is performed only on the front side of the recording sheet P, the recording sheet P in this state is discharged to the discharge tray 9 by the second discharge roller 5 and the first discharge roller 4.

A case where recording is performed on both sides will now be described. Recording on the first side (front side) has been described above. In the case of duplex recording, when the recording on the first side is finished, the recording sheet P is not discharged but the conveyance is temporarily stopped, with the recording sheet P being pinched by the second discharge roller 5 and the first discharge roller 4 in combination with the respective pinch rollers 8 and 7.

Figure 5A:
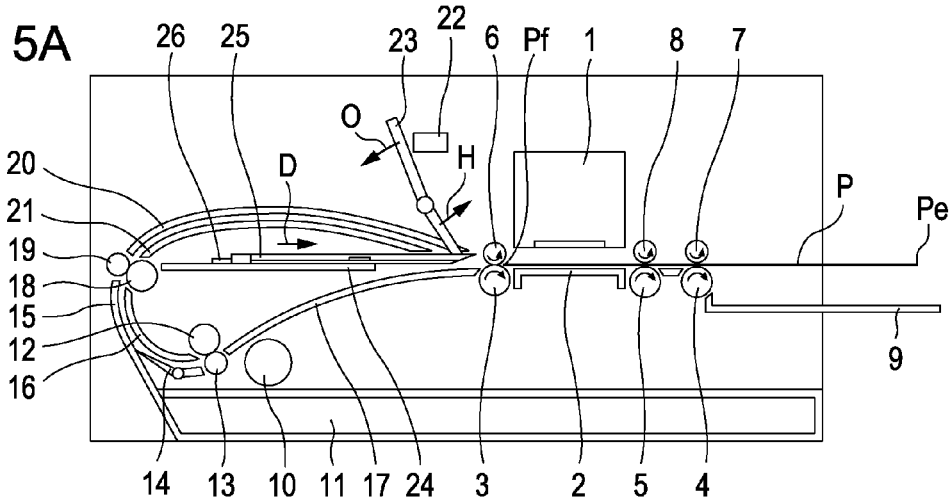
FIGS. 5A through 5C are diagrams for describing a recording operation.

Subsequently, the pinion motor 323 is driven, whereby the conveyance tray 25 is moved in the direction of an arrow D as shown in FIG. 5A and is stopped at a position where paper guiding in backward conveyance for recording on the second side (back side) is to be performed. In this motion, the conveyance tray 25 comes into contact with the sensor lever 23 and causes the sensor lever 23 to turn in the direction of the arrow H. The sensor detection portion at the upper end of the sensor lever 23 moves in the direction of the arrow O, and the sensor 22 detects that the conveyance tray 25 has moved to a duplex guiding position, which is a guiding position. In this embodiment, it is not necessary to provide a mechanism that causes the sensor lever 23 to retract upward so as to allow the recording sheet P to be conveyed in the backward direction for duplex recording. Moreover, since the detection of the recording sheet and the detection of the movement of the conveyance tray 25 to the duplex guiding position are performed with a common sensor, costs can be reduced and the apparatus can be simplified.

Figure 5B:
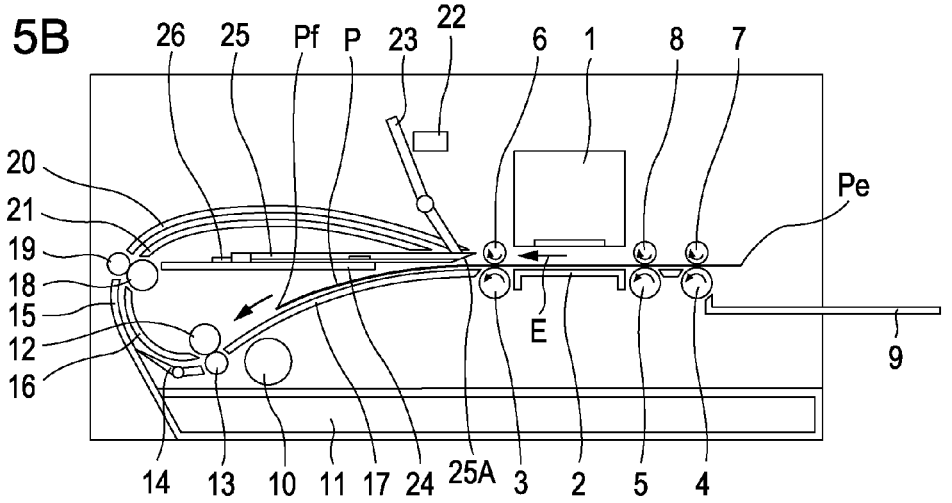
Figure 5C:
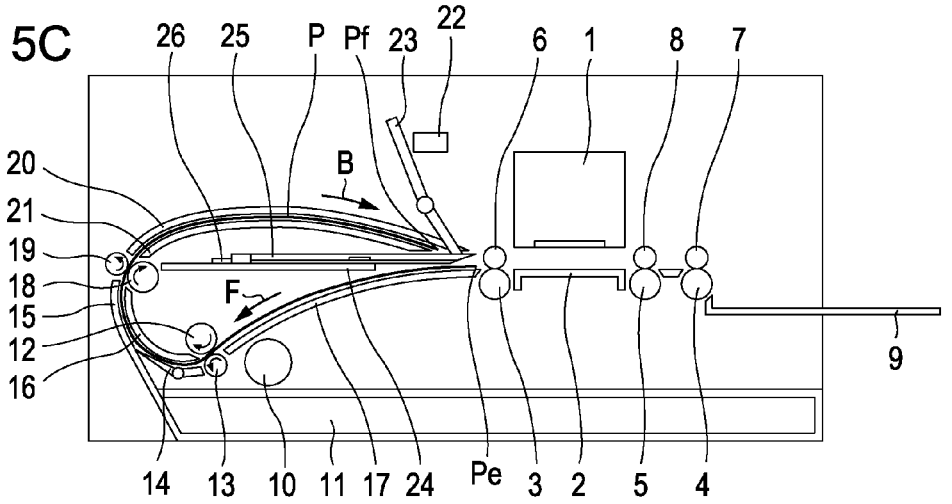

Subsequently, as shown in FIG. 5B, the recording sheet P is conveyed in the direction of an arrow E, which is the backward direction, by the second discharge roller 5, the first discharge roller 4, and the conveyance roller 3. The leading end Pf of the recording sheet P that is conveyed in the backward direction is guided by a sloping surface 25A, which is a guide surface provided at the tip of the conveyance tray 25, and is conveyed along the duplex conveyance guide 17 in the direction of an arrow F. Furthermore, as shown in FIG. 5C, the recording sheet P is conveyed in the direction of the arrow B by the duplex conveyance roller 12 in the duplex conveyance path and the intermediate conveyance roller 18 in the feeding path.

When the trailing end Pe of the recording sheet P has passed the conveyance roller 3 and the leading end Pf of the recording sheet P has reached a position immediately before the conveyance tray 25, the driving of the duplex conveyance roller 12 and the intermediate conveyance roller 18 is stopped.

Figure 6A:
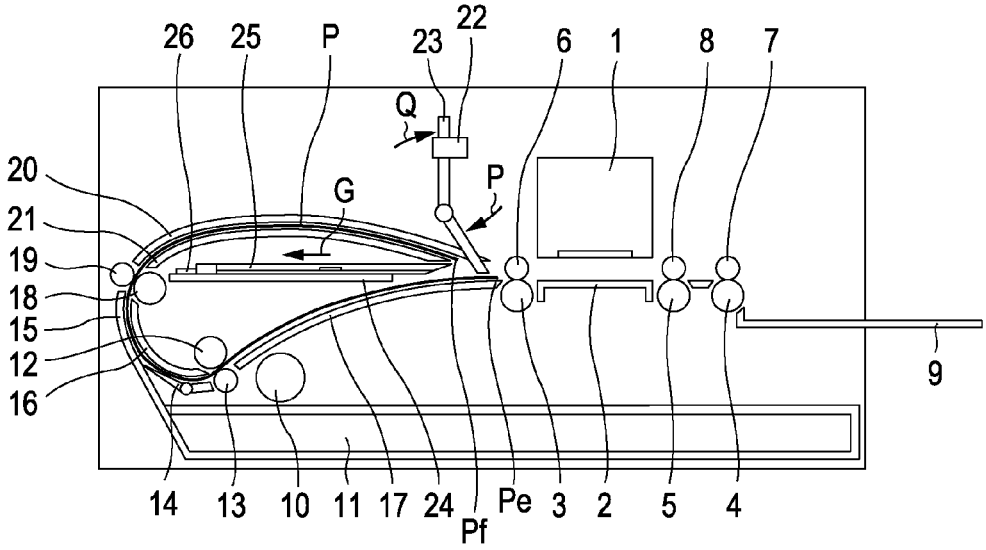
FIGS. 6A and 6B are diagrams for describing the recording operation.

Subsequently, as shown in FIG. 6A, the conveyance tray 25 is moved in the direction of an arrow G and is stopped at a housed position. Here, the conveyance tray 25 moves away from the sensor lever 23. The lower end of the sensor lever 23 moves in the direction of an arrow P, and the detection portion of the sensor lever 23 moves in the direction of an arrow Q. The sensor 22 detects that the conveyance tray 25 has moved from the paper-conveyance-guiding position for duplex conveyance. Simultaneously, since the conveyance tray 25 retracts from the position where the conveyance tray 25 blocks the path extending from the feeding path to the conveyance roller 3, conveyance of the recording sheet P from the feeding path to the conveyance roller 3 is allowed.

Figure 6B:
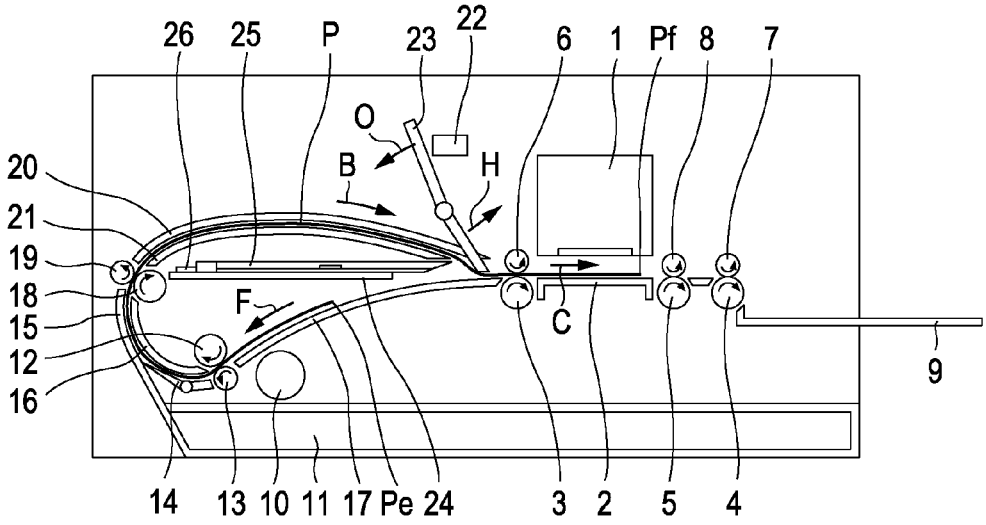

Subsequently, as shown in FIG. 6B, the recording sheet P is conveyed in the direction of the arrow B by the duplex conveyance roller 12 and the intermediate conveyance roller 18 in the feeding path. The recording sheet P causes the sensor lever 23 to swing, and the sensor 22 detects the passage of the recording sheet's leading end Pf. In accordance with the detection of the recording sheet's leading end Pf, the recording sheet P is stopped at the initial position for recording and recording is then performed on the back side (the second side) of the recording sheet P. After the recording on the back side is finished, the recording sheet P is discharged to the discharge tray 9. Thus, duplex printing ends.

An operation performed in printing on a disc recording medium will now be described.

In response to a command to perform printing on a disc recording medium, the pinion gear 32 is rotated by the pinion motor 323 in the direction P shown in FIG. 3, and the conveyance tray 25 moves in the direction I. The conveyance tray 25 moves from a waiting position (FIG. 1) at which the conveyance tray 25 is housed in a space on the inside of the duplex conveyance path to the conveyance roller 3 while being guided along the conveyance tray guide 24. Here, the conveyance assisting members 26 rotatably provided in a folded state at the corners of the rear end of the conveyance tray 25 are rotated by the unshown guide mechanism in the directions Q and R, respectively, as shown in FIG. 3. Furthermore, the conveyance tray 25 is pinched by the conveyance roller 3 and the pinch roller 6 and is conveyed in the direction I shown in FIG. 7A. Here, the pinion gear 32 is released from the rack 25C. Then, the conveyance assisting members 26 extend parallel to the conveyance direction. As shown in FIG. 7B, after the conveyance tray 25 passes the conveyance roller 3, the conveyance tray 25 is moved such that the conveyance assisting members 26 are pinched and conveyed by the conveyance roller 3 and the pinch roller 6. Furthermore, the driven roller 8 retracts from the second discharge roller 5 in the direction of an arrow R, and the driven roller 7 also retracts from the first discharge roller 4 in the direction of the arrow R. Therefore, the driven rollers 7 and 8 may be of spur type having pointed projections on the peripheries thereof. In the state where the conveyance assisting members 26 are pinched by the conveyance roller 3 and the pinch roller 6, the conveyance tray 25 passes the first discharge roller 4 and is moved to a user set position on the front of the body. The conveyance tray 25 is conveyed in the direction of the arrow I and is stopped at a disc-recording-medium set position on the front of the body of the apparatus. FIG. 7B is a perspective view of the conveyance tray 25, seen from the front side of the body, that has been stopped at the disc-recording-medium set position.

Subsequently, a disc recording medium 27 is set in a circular recess 25B provided in the conveyance tray 25 for setting a recording medium, the conveyance tray 25 remaining still at the set position. When the disc recording medium 27 has been set as shown in FIG. 8B, printing on the disc recording medium is started.

Figure 8A:
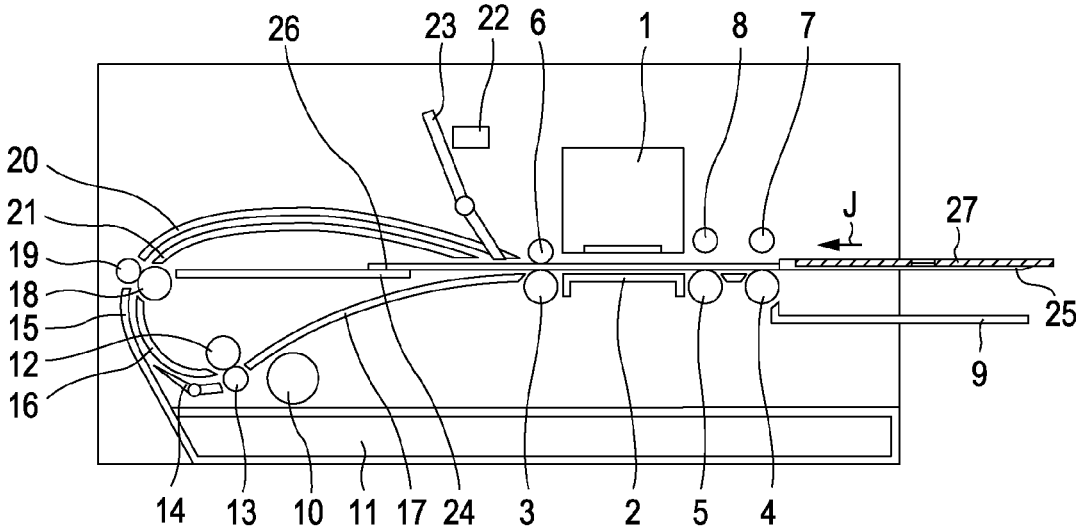
FIGS. 8A and 8B are diagrams for describing the operation performed when recording is performed on the disc recording medium.
Figure 8B:
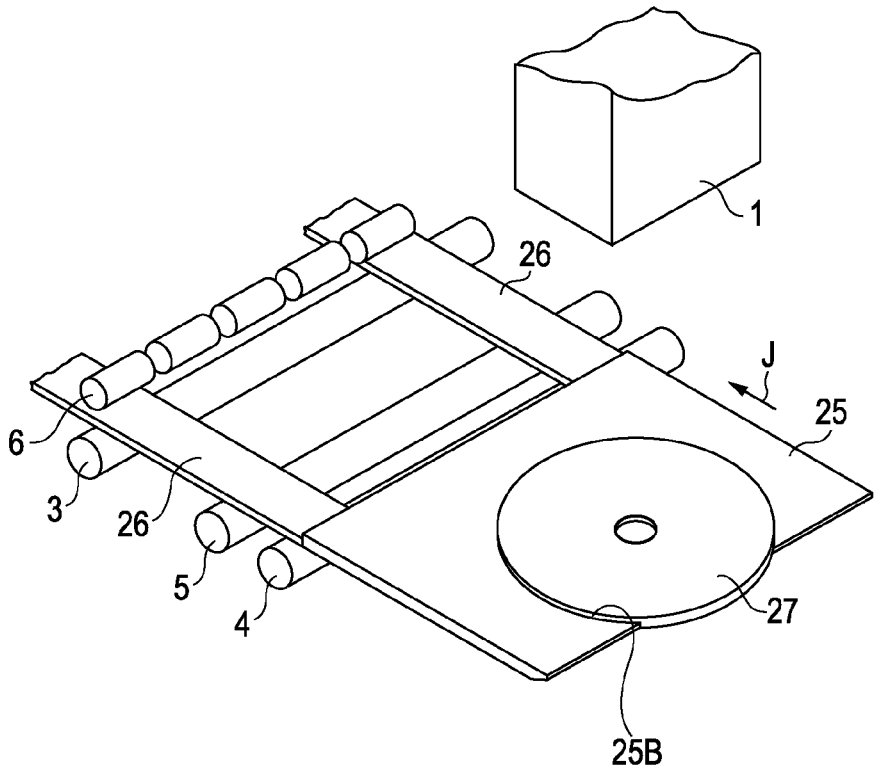
Figure 9:
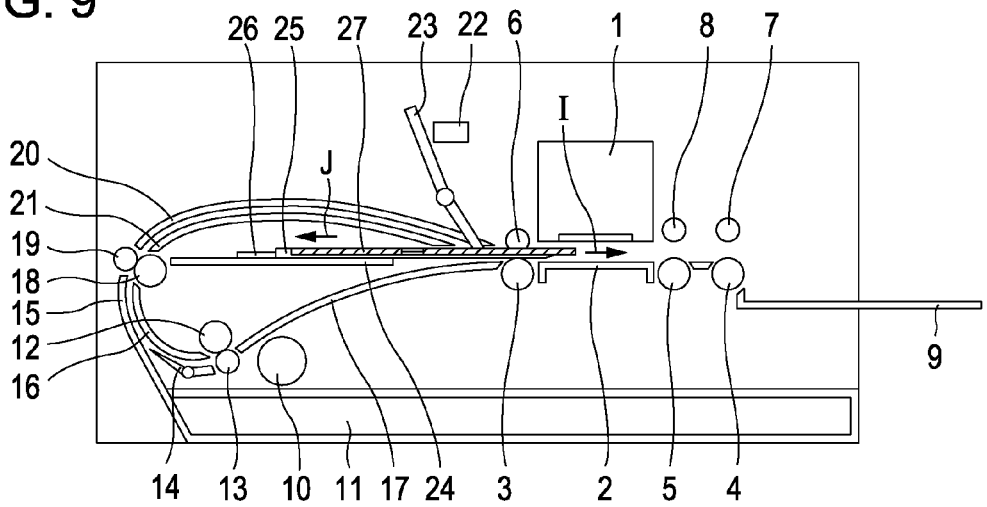
FIG. 9 is a diagram for describing the operation performed when recording is performed on the disc recording medium.

When the conveyance roller 3 is rotated counterclockwise in FIG. 8A, the conveyance tray 25 together with the conveyance assisting members 26 are conveyed in the direction of an arrow J. The conveyance tray 25 is conveyed such that a portion thereof is drawn into the area enclosed by the duplex conveyance path as shown in FIG. 9, and is stopped at a printing start position for the disc recording medium 27.

Subsequently, the conveyance roller 3 rotates clockwise, and the conveyance tray 25 is conveyed in the direction of the arrow I in such a manner as to pass the recording unit. Recording on the recording medium that is set in the conveyance tray 25 is performed by the recording head 1. When the recording is finished, the conveyance tray 25 is stopped at the position shown in FIGS. 8A and 8B. Here, if printing is to be performed on another disc recording medium 27, the disc recording media 27 are changed and the above operation is repeated. If the printing is to be ended, the disc recording medium 27 is removed and the conveyance tray 25 is conveyed in the direction of the arrow J again by the conveyance roller 3. When the conveyance tray 25 passes the conveyance roller 3, the pinion gear 32 is moved to such a position as to mesh with the rack 25C and is rotated, whereby the conveyance tray 25 is further conveyed in the direction of the arrow J. When the conveyance tray 25 has reached the housed position shown in FIG. 1, the recording operation ends.

In this embodiment, since the conveyance tray 25 is housed in the area enclosed by the duplex conveyance path, the recording apparatus capable of performing printing on a disc recording medium and duplex printing can be downsized. The area enclosed by the duplex conveyance path is no longer a dead space and can be utilized efficiently.

Second Embodiment

In the first embodiment, the tip 25A of the conveyance tray 25 housed in the area enclosed by the duplex conveyance path is used as a conveyance paper guide that guides the recording sheet into the duplex conveyance path. In a second embodiment, a conveyance paper guide that guides the recording sheet is provided. The conveyance paper guide is moved by moving the conveyance tray 25.

Figure 10A:
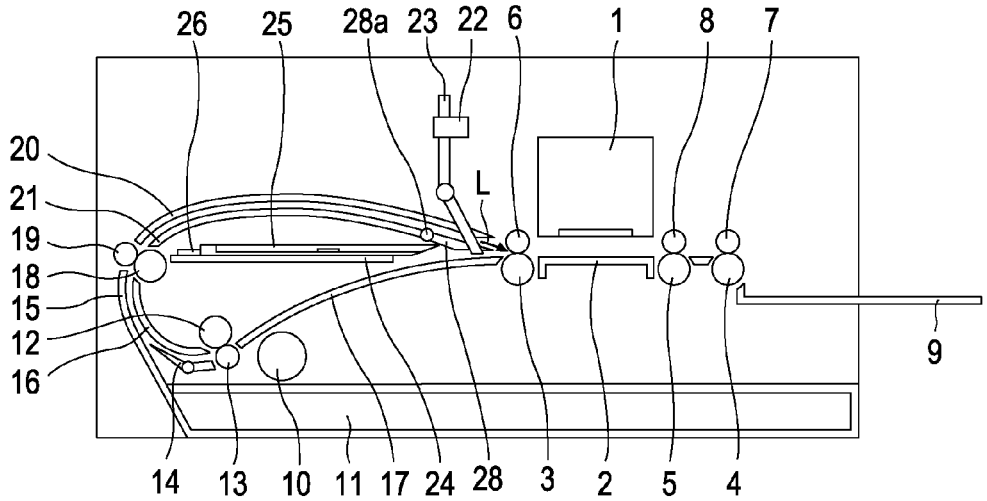
FIGS. 10A and 10B are schematic cross-sectional views of a recording medium according to a second embodiment of the present invention.
Figure 10B:
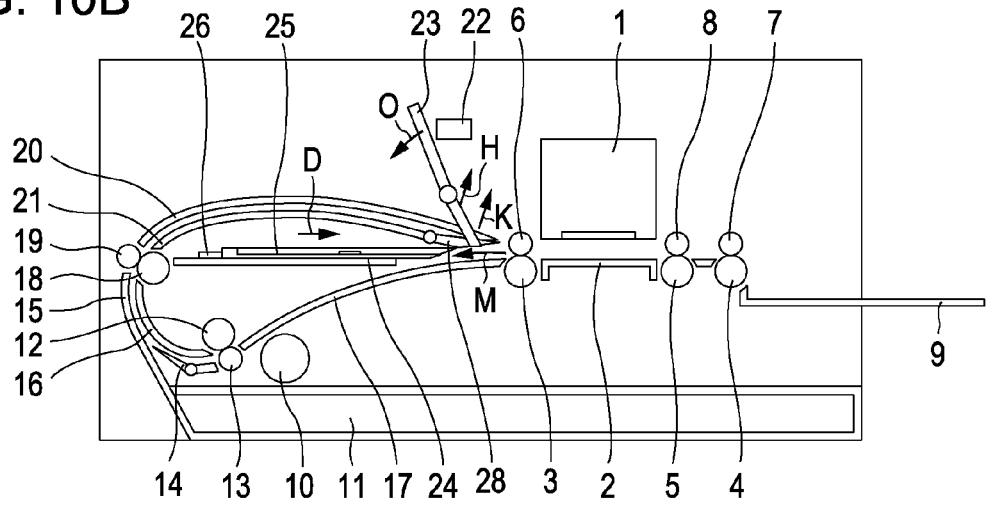

FIGS. 10A and 10B show a recording apparatus according to the second embodiment of the present invention. Descriptions of configurations identical with those in the first embodiment are omitted. In FIG. 10A, a paper guide flapper 28, which is a guide member, is supported by a shaft 28*a* in such a manner as to be swingable between a first position and a second position. In FIG. 10A, the paper guide flapper 28 is positioned at the first position, which is a feeding-and-guiding position. Each of recording sheets stacked in the feeding-and-stacking unit 11 and fed by the feeding roller 10 is guided by the conveyance guides 15 and 16, is conveyed by the intermediate conveyance roller 18, is further guided by the conveyance guides 20 and 21, and is further guided to the conveyance roller 3 by the upper surface of the paper guide flapper 28 positioned at the feeding-and-guiding position. Then, while the recording sheet P is being conveyed by the conveyance roller 3, recording is performed by the recording head 1.

If duplex recording is to be performed after the recording on the first side is finished, the pinion gear 32 is rotated, whereby the conveyance tray 25 is moved in the direction of the arrow D shown in FIG. 10B. The paper guide flapper 28 is pushed upward by the conveyance tray that is being moved, and turns in the direction of an arrow K. The paper guide flapper 28 that is turning comes into contact with the sensor lever 23 and causes the sensor lever 23 to turn in the direction of the arrow H. The upper end of the sensor lever 23 moves in the direction of the arrow O. Thus, the sensor 22 detects that the paper guide flapper 28 has moved to the second position, which is a duplex conveyance position.

The recording sheet P having recording performed on the first side thereof is conveyed in the direction of an arrow M by the first discharge roller 4, the second discharge roller 5, and the conveyance roller 3, and is guided to the duplex conveyance guide 17 by the lower surface of the paper guide flapper 28, the surface being a guide surface. The recording sheet is further conveyed to the conveyance guide 15 by the duplex conveyance roller 12. Subsequently, recording onto the second side is performed in the same manner as in the case of the recording onto the first side.

Third Embodiment

In the first embodiment, recording sheets not having recording performed thereon yet are stacked below the duplex conveyance path, i.e., at the bottom of the recording apparatus. The present invention may also be applied to a recording apparatus in which a recording-sheet-stacking unit is provided above the duplex conveyance path and the recording sheets are each fed therefrom and recording is performed. The present invention may also be applied to a recording apparatus including recording-sheet-stacking units at the bottom of the recording apparatus and above the duplex conveyance path, respectively.

It is an object of the present invention to provide a downsized recording apparatus capable of housing thereinside a holding member that holds a disc recording medium so as to convey the disc recording medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Application No. PCT/JP2009/070921, filed Dec. 15, 2009, which is hereby incorporated by reference herein in its entirety.

What is claimed is:

1. A recording apparatus comprising:

a conveyance unit configured to convey a sheet;

a recording unit configured to record on the sheet conveyed by the conveyance unit;

a duplex conveyance path configured to reverse the sheet, on a first side of which the recording has been performed and to convey the sheet to the conveyance unit;

a holding member configured to hold a disc recoding medium;

a moving unit that moves the holding member to a position where the holding member is conveyable by the conveyance unit so that the holding member is conveyed by the conveyance unit; and a guide surface, provided on the holding member, configured to guide the sheet conveyed by the conveyance unit to the duplex conveyance path, when the holding member is located at a guiding position, wherein the holding member is moved by the moving unit to the guiding position.

2. The recording apparatus according to claim 1, wherein, when the holding member is located at the guiding position, the guide surface guides to the duplex conveyance path the sheet having recording performed on the first side thereof and being conveyed by the conveyance unit.

3. The recording apparatus according to claim 2, wherein the guide surface is provided on a swingable guide member, wherein the guide member is movable between a first position where the sheet is guided from the duplex conveyance path to the conveyance unit and a second position where the guide surface is positioned at the guiding position, and wherein the guide member moves from the first position to the second position by coming into contact with the holding member that is moved by the moving unit.

4. The recording apparatus according to claim 2, further comprising sheet detecting unit having a sensor lever that swings by coming into contact with the sheet, wherein, when the holding member is moved so as to move the guide surface to the guiding position, the sensor lever retracts to a position where the sensor lever is prevented from coming into contact with the sheet.

5. The recording apparatus according to claim 4, wherein the sensor lever moves to the position where the sensor lever is prevented from coming into contact with the sheet by coming into contact with the holding member that is being moved.

6. The recording apparatus according to claim 4, wherein the sheet detecting unit detects the movement of the holding member by detecting that the sensor lever has retracted to the position where the sensor lever is prevented from coming into contact with the sheet.

7. The recording apparatus according to claim 1, further comprising a stacking unit in which sheets are stacked, a feeding unit that feeds each of the sheets stacked in the stacking unit, and a feeding path that guides to the duplex conveyance path the sheet fed by the feeding unit.

8. The recording apparatus according to claim 7, wherein the stacking unit is provided below the duplex conveyance path.

* * * * *